US009532428B2

(12) United States Patent
Bialoskorski et al.

(10) Patent No.: US 9,532,428 B2
(45) Date of Patent: Dec. 27, 2016

(54) INTERACTIVE SYSTEM AND METHOD FOR SENSING MOVEMENT

(75) Inventors: Leticia Sofia Susanna Bialoskorski, Eindhoven (NL); Joanne Henriette Desiree Monique Westerink, Eindhoven (NL); Egidius Leon Van Den Broek, Nijmegen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 315 days.

(21) Appl. No.: 13/255,334

(22) PCT Filed: Mar. 3, 2010

(86) PCT No.: PCT/IB2010/050906

§ 371 (c)(1),
(2), (4) Date: Sep. 8, 2011

(87) PCT Pub. No.: WO2010/103427

PCT Pub. Date: Sep. 16, 2010

(65) Prior Publication Data

US 2012/0001766 A1 Jan. 5, 2012

(30) Foreign Application Priority Data

Mar. 10, 2009 (EP) ..... 09154741

(51) Int. Cl.

| | |
|---|---|
| ***G08B 21/00*** | (2006.01) |
| ***H05B 33/08*** | (2006.01) |
| ***H05B 37/02*** | (2006.01) |

(52) U.S. Cl.

CPC ..... *H05B 33/0863* (2013.01); *H05B 33/0857* (2013.01); *H05B 37/029* (2013.01)

(58) Field of Classification Search

CPC ..... H05B 33/0857; H05B 33/0863; H05B 37/029

USPC ..... 340/686.1, 500, 540, 691.1, 691.6, 691.8,340/692, 815.83; 700/18, 186–193; 36/137; 362/103

See application file for complete search history.

(56) References Cited

U.S. PATENT DOCUMENTS

| | | | | |
|---|---|---|---|---|
| 5,170,002 | A * | 12/1992 | Suzuki | G10H 1/00 84/600 |
| 5,192,823 | A * | 3/1993 | Suzuki | G10H 1/32 84/600 |
| 5,290,964 | A * | 3/1994 | Hiyoshi | G06F 3/014 84/600 |
| 5,406,300 | A * | 4/1995 | Tokimoto et al. | 345/31 |
| 6,265,984 | B1 * | 7/2001 | Molinaroli | 340/815.4 |
| 6,626,728 | B2 * | 9/2003 | Holt | 446/219 |
| 6,897,624 | B2 | 5/2005 | Lys et al. | |

(Continued)

FOREIGN PATENT DOCUMENTS

| | | | |
|---|---|---|---|
| CN | 1902672 | A | 1/2007 |
| JP | 2001347080 | A | 12/2001 |

(Continued)

OTHER PUBLICATIONS

Chang et al: Lumitouch: An Emotional Communication Device, CHI EA '01, ACM 2001, 2 Page Article.

(Continued)

*Primary Examiner* — Sisay Yacob

(57) ABSTRACT

A system for sensing emotions, which produce color or sound variation in a series of elements, which experience different patterns of movement.

15 Claims, 10 Drawing Sheets

(56) References Cited

U.S. PATENT DOCUMENTS

| | | | | |
|---|---|---|---|---|
| 7,183,480 | B2 * | 2/2007 | Nishitani | G10H 1/00 84/609 |
| 7,474,197 | B2 * | 1/2009 | Choi et al. | 340/384.7 |
| 2001/0015123 | A1 * | 8/2001 | Nishitani | A63B 71/0686 84/615 |
| 2002/0101197 | A1 | 8/2002 | Lys et al. | |
| 2003/0028260 | A1 * | 2/2003 | Blackwell | 700/18 |
| 2003/0070324 | A1 | 4/2003 | Nelson | |
| 2005/0213476 | A1 * | 9/2005 | Choi et al. | 369/127 |
| 2007/0008096 | A1 | 1/2007 | Tracy | |
| 2009/0044625 | A1 | 2/2009 | Chang | |

FOREIGN PATENT DOCUMENTS

| | | | |
|---|---|---|---|
| JP | 2002203401 | | 7/2002 |
| JP | 2008532587 | A | 8/2008 |
| WO | 2006038135 | A1 | 4/2006 |
| WO | 2006054263 | A1 | 5/2006 |
| WO | 2006090371 | A2 | 8/2006 |
| WO | 2008044187 | A1 | 4/2008 |
| WO | 2008139630 | A1 | 11/2008 |
| WO | 2009126279 | A1 | 10/2009 |

OTHER PUBLICATIONS

Kikin-Gil: "Buddybeads:Mediating Social Relationship Through Mobile Communication"; Thesis Report, Interaction Design Institute, IVREA 2005, 50 Page Document.

Quintanilha: "Buddywall: A Tangible User Interface for Wireless Remote Communication"; CHI 2008 Proceedings, Apr. 5-10, 2008, ACM 978-1-60558-8, pp. 3711-3716.

Lee et al: "Emotional Interaction Through Physical Movement";J. Jacko (Ed.): Human-Computer Interaction, Part III, HCII 2007, LNCS 4552, pp. 401-410, 2007.

Stahl et al: "A Foundation for Emotional Expressivity"; Proceedings of the 2005 Conference on Designing for User Experience. vol. 135, American Institute of Graphic Arts, New York, 2005, 22 Page Document.

* cited by examiner

INTERACTIVE SYSTEM AND METHOD FOR SENSING MOVEMENT

FIELD OF THE INVENTION

The present invention relates to a method of communication with improved interactivity features, and to a communication system.

BACKGROUND OF THE INVENTION

Non-verbal communication plays a main role in connection of people, machine entities, etc., which physically encounter as well as when they communicate while physically located in different places.

Efficient communication of emotions, in particular when communicating remotely, needs aids in order to replace emotional and paralinguistic cues, which are dominant in face-to-face communication. Moreover, it is generally hard to attain efficient emotional communication between several individuals, e.g. in big arenas or at crowded events, when efficient verbal communication cannot be achieved.

JP2002203401 describes a light with a function to sense motion capable of varying light emission according to the way the user swings it. Changes in emotions of the user may be thereby communicated by change of the motions of these lights, motions which are transduced into color changes of the light emitted. In this way, the user can only partially communicate his emotion and has no possibility to interact with and/or influence any other users' communication of emotions.

Hence, an improved communication system in which user inputs may be combined together in order to acquire a common communication of emotion would be advantageous.

Another problem is that control of light emission from multiple elements is normally achieved by complex user interface systems.

Hence, a more efficient and/or reliable way to control light emission of multiple elements without the use of complex user interface would be advantageous.

SUMMARY OF THE INVENTION

Accordingly, the invention preferably seeks to mitigate, alleviate or eliminate one or more of the above-mentioned disadvantages singly or in any combination. In particular, it may be seen as an object of the present invention to provide a communication system that solves the above mentioned problems of the prior art by providing a communication system which includes elements for communicating users emotional states by light emission. The communication between the elements is so that the light emission in one element may be influenced by the light emission of one or more other elements. This higher degree of interactivity between the elements of this system allows a more efficient emotion communication between the users of the system.

A system according to the invention comprises:

at least two functionally connected elements (1-4) adapted by means of their mass and provision to be moved by a user, each element comprising a light or sound emitting device (5-8), at least one motion sensor (9) for sensing motion of the elements, a control system (10) for controlling the emission of the light or sound from said two or more elements, the control system being arranged to receive inputs from said one or more motion sensors and configured to, in response to input indicating the movement of a first element, control the light or sound emitted by the first element and at least one other element.

It can be seen as another object of the present invention to provide a control of light emission from multiple elements without the presence of any conventional user interface (U.I.). Generally control of multiple light emitters is achieved by using different U.I.'s like switches, knobs and buttons. The use of these conventional U.I.'s may have several disadvantages, such as being complex or easily affected by environmental conditions. The present invention seeks to mitigate, alleviate or eliminate the mentioned disadvantage by allowing the control of the multi-elements light emission through the simple movement of at least one element. For example, the coloration of one element may be changed from yellow to purple without having to use any conventional U.I. by simply jerking the element at a specific speed. Moreover, with the elements being functionally connected, applying a motion to one element may change the light emission of other elements without having the user to physically interact with these other elements.

This object and several other objects are obtained in a first aspect of the invention by providing a system for communication, the system comprising:

i) two or more functionally connected elements adapted by means of their mass and provision to be moved by a user, each element comprising a light emitting device for emitting light;

ii) one or more motion sensors for sensing elements motion;

iii) a control system for controlling the emission of the light from said two or more elements, the control system being arranged to receive inputs from said one or more motion sensors and configured to, in response to input indicating the movement of a first element, control the light emitted by the first element and at least one other element.

The control system may be a single central unit or may be provided by a number of processor distributed among elements.

For example during a sport event, where elements are provided to the spectators, users of the elements cheering for their favorite team may produce a color change in their elements by particular agitation patterns and therefore show their emotion towards their favorite team and towards the other spectators. By sensing each other's movements, the elements may influence each other's coloration and therefore may provide an atmosphere of unity between a group of people cheering for the same team. Spectators particularly active in their cheering/movements of their elements may therefore produce coloration which, by influencing other elements' coloration, will communicate the spectators emotion to other close spectators and provide spectacular wave effect around sports arenas.

Another example of the use of the invention may be a more limited installation where several users may communicate their emotions by moving elements and therefore inducing coloration change of the elements close by. Other users may intervene by inducing chromatic variation of the installation through different movements of the elements and therefore communicating their emotion in a game-like mode.

In all examples the control of the light emission of the elements is obtained by the user through simple movements and without using conventional U.I.'s.

In a second aspect the invention relates to a method for communication, the method comprising the steps of:

i) generating motion of elements in a system for communication comprising two or more functionally connected elements adapted by means of their mass and provision to be moved by a user, each element comprising a light emitting device for emitting light;

ii) sensing the motion of the elements; and iii) controlling the emission of the light from a first element in response to a sensed motion of the first element and/or at least one other element.

In the following, a number of preferred and/or optional features, elements, examples and implementations will be described. Features or elements described in relation to one embodiment or aspect may be combined with or applied to the other embodiments or aspects where applicable. For example, structural and functional features applied in relation to the system may also be used as features in relation to the method by proper adaptation and vice versa.

The one or more motion sensors may detect amplitude, speed and direction of elements' individual motion and their relative motion. The motion sensor(s) may be also able to determine the acceleration and the angular rate of rotation of the elements.

In some embodiments, the one or more motion sensors are distributed so that each element comprises a motion sensor.

In one embodiment, the motion sensor for detecting rotation of the elements is preferably a three-dimensional acceleration sensor. Such sensor allows determining both rotation and tilting of the elements as well as translational motion. Most often, movements are a combination of tilting, rotation, and translation movements. When the element is not in motion for example lying on a table the rotation detection may be disabled.

The control of light emission preferably comprises controlling the color and/or luminosity of the emitted light.

Elements' movements of the users are transduced into light emission which is herein defined as variation in amplitude and frequency/wavelength of the electromagnetic field.

Color variations are defined as a chromatic variation in the emission of light by the light emitting devices located in or onto the elements. Chromatic variation may be obtained for example by inducing the elements to selectively emitting light at different single wavelengths or by inducing the elements to emit light in different regions of the visible spectrum.

Variation of luminosity is defined as the variation of the intensity of light emission of the light emitting devices.

In some embodiments the light emitting device comprises LEDs emitting light having diverse coloration.

Light-emitting-diodes (LEDs) are particularly, but not exclusively, advantageous for their small size, low power consumption, low costs, and versatility of color emission which can span between near infrared, visible, to ultraviolet. Narrow and broad bandwidth LEDs emitting at diverse wavelengths can be combined in multiple arrays to produce most perceptible colors, including white.

In some other embodiments the light-emitting device of the system according to first aspect of the invention comprises a polychromatic source of light and optical filters.

Polychromatic sources of light are generally broadband continuous lighting systems, which emit white light that can be selectively tuned in diverse colors by using optical filters, such as colored density filters.

It is preferred that, in each element, said light emitting device is arranged so that emitted light is visible from at least two opposing sides of the element. This provides the advantage both the user and somebody watching the user can see the emitted light at the same time. This may be obtained by comprising a light diffusing or diffracting element, surface or housing for the element or the light emitting device.

In a preferred implementation, the control of the emission of light from a first element in response to a sensed motion of the first or another element is performed in real time on all elements which is affected by the movement. This means that the resulting change(s) in light emission when an element is moved happens immediately, i.e. typically while the element is moved. For some motion properties, e.g. periodic movements, there may be some redundancy while the control system determines the characteristics of the motion property to provide the corresponding light emission. For other motion properties, e.g. speed, the control system can react instantly, as fast as a speed can be determined. Also, small delays due to sensor response times and sampling rates, signal transmissions and receptions, processing time etc. are to be expected but will typically not be registered or experienced as disturbing for a user. A system operating with the delays and redundancy described here is considered performing light control in response to a sensed motion in real time.

What is not considered a real time response is if a user finishes a series of motions, where after the congregate motions are send as a message package and thereafter displayed or otherwise conveyed by another element.

Although the description of the present invention focuses on light variation, it is envisaged that the invention is generally applicable to the control of different outputs so that for example a motion of the elements corresponds the emission of a sound. Sound waves are characterized by similar generic properties of waves, namely frequency/wavelength and amplitude. The description in this invention regarding light control can thereby easily be adapted to sound control by adding a sound emitting device or replacing the light emitting device with a sound emitting device, such as a signal generator and a loudspeaker. For example a sound emission from one element may influence other elements' sound emissions. Sound emission from one element may also influence other elements' light emission and vice-versa.

In some embodiments control of light emission also comprises inducing periodical variations of the emitted light.

Periodical variations are defined as a variation that happens or recurs at regular intervals of time. In this way element's rhythmical motion may be transduced into sequential colorations change. For example to specific element motions may correspond a specific time and sequence of fades and pulsations of light from the light emitting devices.

In other embodiments the system further comprises an information storage unit for storing inputs from said one or more motion sensors. In these embodiments, the control system is preferably further arranged to receive inputs from said information storage unit and, in response to said received inputs, configured to selectively induce said elements to produce variation in their light emission The information storage unit serves as memory unit where inputs from the motion sensors are stored. For example the received inputs may be stored in the information storage unit to provide information about the chronological sequence of the motion of the elements. Thereby the control system, receiving information about the chronological sequence of the motion of the elements from the information storage unit, may induce a variation in light emission of some elements which is, at least partially, based on its own recent motion history. In other embodiments the motion history of one element may influence the variation in light emission of other elements.

In response to specific inputs from the motion sensor(s), such as no inputs, the control system may preferably induce the elements to randomly emit light with different colors and/or intensity or to repeat emissions from their own recent motion history by retrieving such from the information storage unit. For example if the recent motion history of some elements shows that they haven't been in motion for a long period, the elements may randomly emit light to attract the attention of potential users.

Communication to/from elements may be through wired connections or by means of wireless communication involving a transmitter/receiver in each element. The communication may be based on standard communication protocols for wired/wireless communication. Most often, only a limited amount of data need to be send/received.

Administration of the communication between elements can be based on a central hub (which may be housed by one of the elements, need not be a separate physical entity) or it can be distributed. The administration of the communication will typically, but not necessarily, be incorporated in the processing capabilities of the control system, which can also be both central and distributed.

In some embodiments the control system further comprises software or hardware or firmware etc. means for determining one or more motion property characteristics of the motion of a first element from the input indicating the movement of the first element, and software means for mapping the determined motion property characteristics into a provided light color and/or intensity space, the control system being further configured to induce the first element to emit light according to its motion property characteristics' position in the light color and/or intensity space.

Examples of motion properties and their characteristics are collected in the following table:

| Motion property | Characteristics of motion property |
|---|---|
| Speed | Fast, slow |
| Changes in directions | Smooth, jerky |
| Temporal pattern | Periodic, sporadic, random |
| Geometrical pattern | Circle, triangle, square, other recognizable forms |
| Direction | Up, down, left, right, forward, backward or combination |
| Rotation/tilt | Clockwise, counterclockwise |

Combining all/or some of these motion properties a multidimensional coordinate system can be built in which each axis is represented by a motion property with a quantification of its characteristics determining a coordinate on the axis. Each movement of the elements can be identified with a specific combination of coordinates, i.e. motion properties, in the multidimensional coordinate system, which may be seen as a motion property space. The position of a specific element's movements in this motion property space may be seen as a mapping of the people's emotions, as to any specific element movement may correspond a specific emotion of a user of the element. The variation in colors/luminosity emission is determined by the correspondence between this motion property space and a color/luminosity scheme so that to each combination of coordinates, i.e. element motion properties, corresponds a specific color and light intensity. Emotional changes in an element's user, which induces the user to introduce change in the element's motion, are thereby ultimate transduced into color and light intensity variation of the light emitted by the element. Examples of color schemes are known in literature. An example for a 2D color scheme is described later in the text.

In a third aspect, the invention relates to a computer program product for instructing a processing unit to execute the steps of the method according to the second aspect when the product is run on a computer, such as on the control system of a system according to the first aspect of the invention.

This aspect of the invention is particularly, but not exclusively, advantageous in that the present invention may be implemented by a computer program product, enabling a computer system to perform the operations of the first aspect of the invention. Thus, it is contemplated that some known system may be changed to operate according to the present invention by installing a computer program product on a computer system controlling an optical recording apparatus. Such a computer program product may be provided on any kind of computer readable medium, e.g. magnetically or optically based medium, or through a computer based network, e.g. the Internet.

The basic idea of the invention can be formulated as to provide a system with a number of elements in which control of luminosity and colors can be obtained by simple motion of its elements which sense each other's movement patterns and influence each other variations. Thereby the communication between the elements of the system allows to induce color variation in elements in which no U.I. are present.

The first, second and third aspects of the present invention may each be combined with any of the other aspects. These and other aspects of the invention will be apparent from and elucidated with reference to the embodiments described hereinafter.

BRIEF DESCRIPTION OF THE FIGURES

The present invention will now be explained, by way of example only, with reference to the accompanying Figures, where.

DETAILED DESCRIPTION OF EMBODIMENTS

In all embodiments of the elements, the control system, the store unit and the motion sensor are functionally connected and may be connected by means of wires or by means of wireless connections. While the descriptions of the embodiments can be applied to systems comprising a large number of elements, the amount of elements described in the embodiments below is reduced to four for simplicity reasons. Typical shape of the elements is spherical however in other embodiments the shape of the elements may be of any shape suitable for the function of being movable, e.g. cubic, pyramidal, and cylindrical or a combination of them. Size, form and weight of the elements may change distinctly between embodiments. The only requirement of the elements is that they should be moveable. Optionally, their form may also be modifiable.

It is preferred that each single element is a single physical entity, i.e. not consisting of several separate entities that may be more or less physically connected. Thereby, it is the element that emits light which is moved and which motion is sensed.

Figure 1:
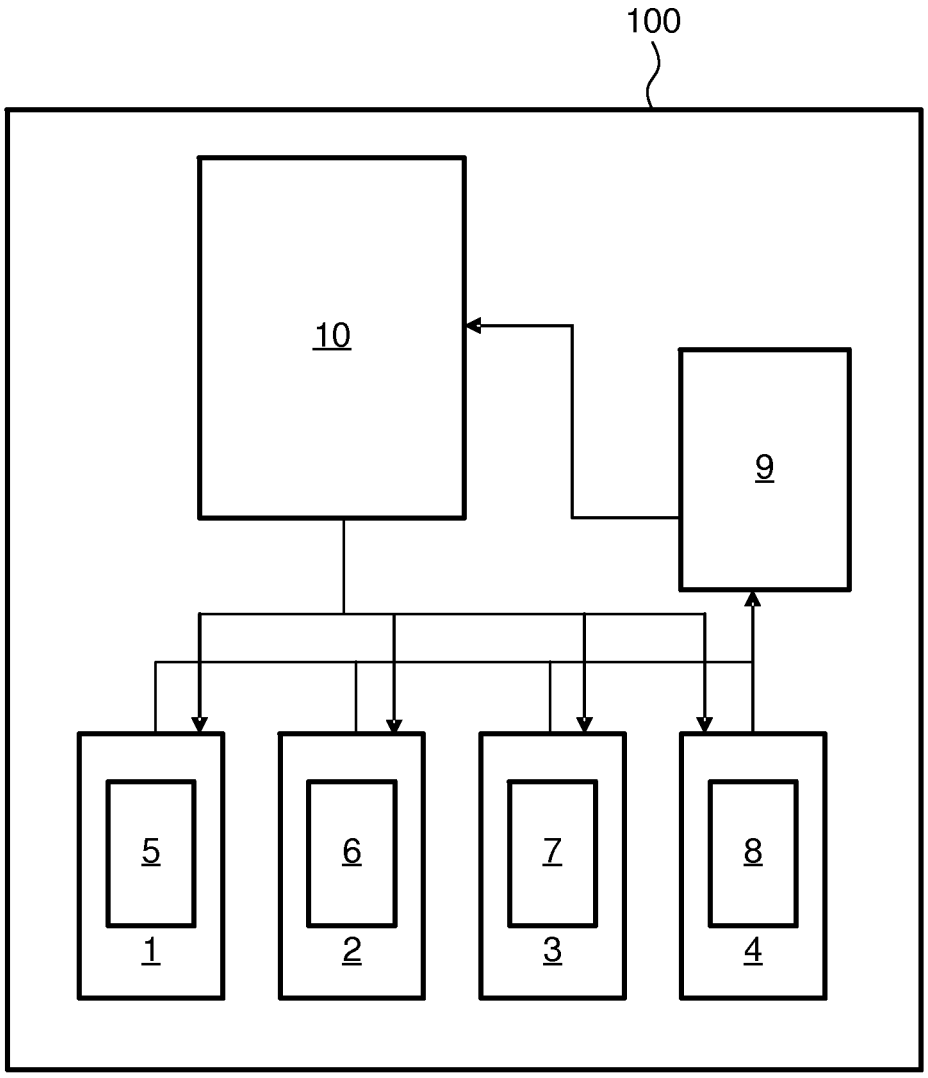
FIG. 1 shows a schematic drawing of the system according to one embodiment of the invention.

FIG. 1 shows a schematic drawing of the system 100 according to one embodiment of the invention. The Figure shows four functionally connected elements 1, 2, 3, and 4 each comprising a light emitting device, 5, 6, 7, 8 respectively. Upon user interaction with the elements the motion sensor 9 senses the movements of the elements. The control system 10 receives information about the motion of the elements from the motion sensor 9 and in response to the received information controls the light emitting devices of the elements, e.g. to induce chromatic and luminosity variations in the emitted light.

Figure 2:
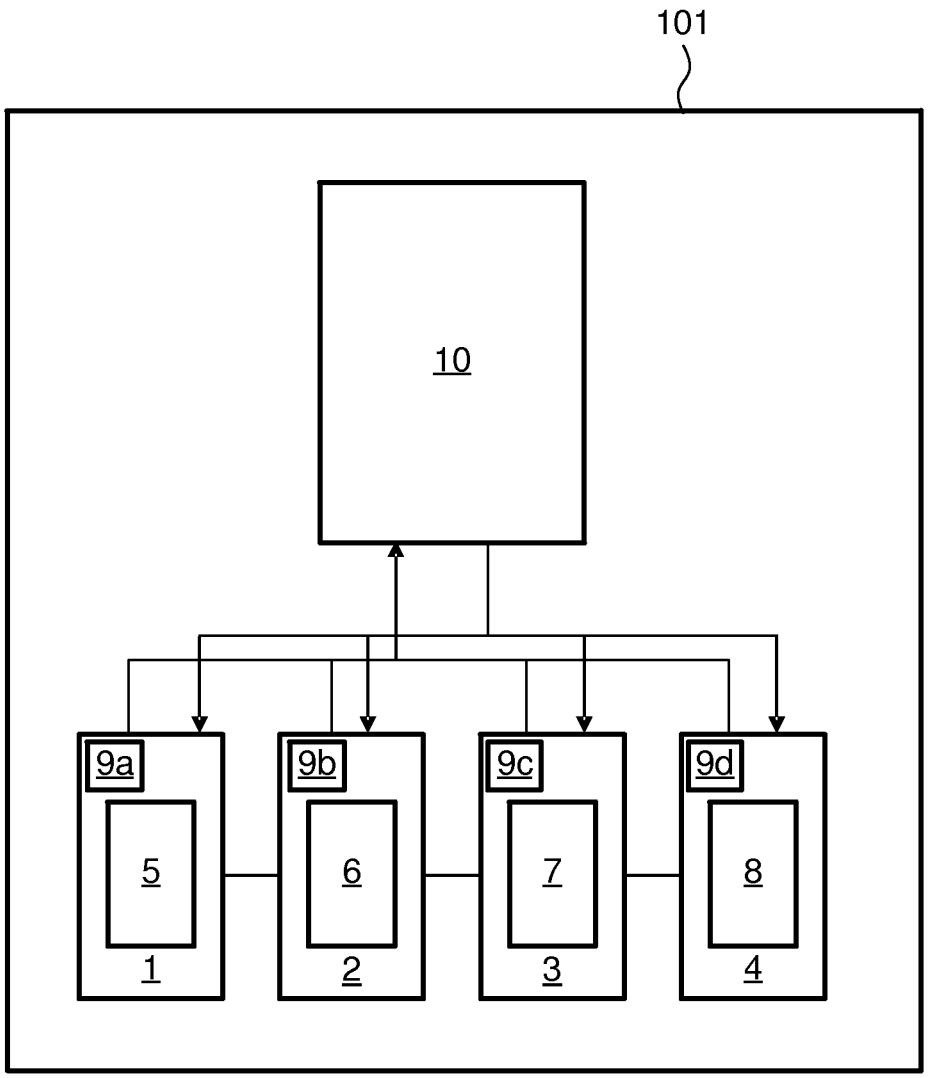
FIG. 2 shows a schematic drawing of the system according to an embodiment of the invention.

FIG. 2 shows a schematic drawing of the system 101 according to one embodiment of the invention wherein the elements 1, 2, 3, and 4 each contain a motion sensor: 9*a*, 9*b*, 9*c* and 9*d* respectively. Upon user interaction with the elements, the motion sensors sense the motion of the elements. Each motion sensor may sense the motion of the element in which it is included, e.g. sensor 9*a* senses motion of element 5.

Alternatively or additionally, each motion sensor may sense the motion of the other elements, e.g. sensor 9*a* senses motion of elements 1, 2, 3, and 4. This may e.g. be embodied by an emitter in each element, emitting an electrical or magnetic field in a dipole or multi-pole configuration, together with a directional electrical field sensor in each device. This will allow an element to determine the motion and position of a neighboring element. The field from each emitter may be modulated for identification of the element containing the emitter.

Figure 3:
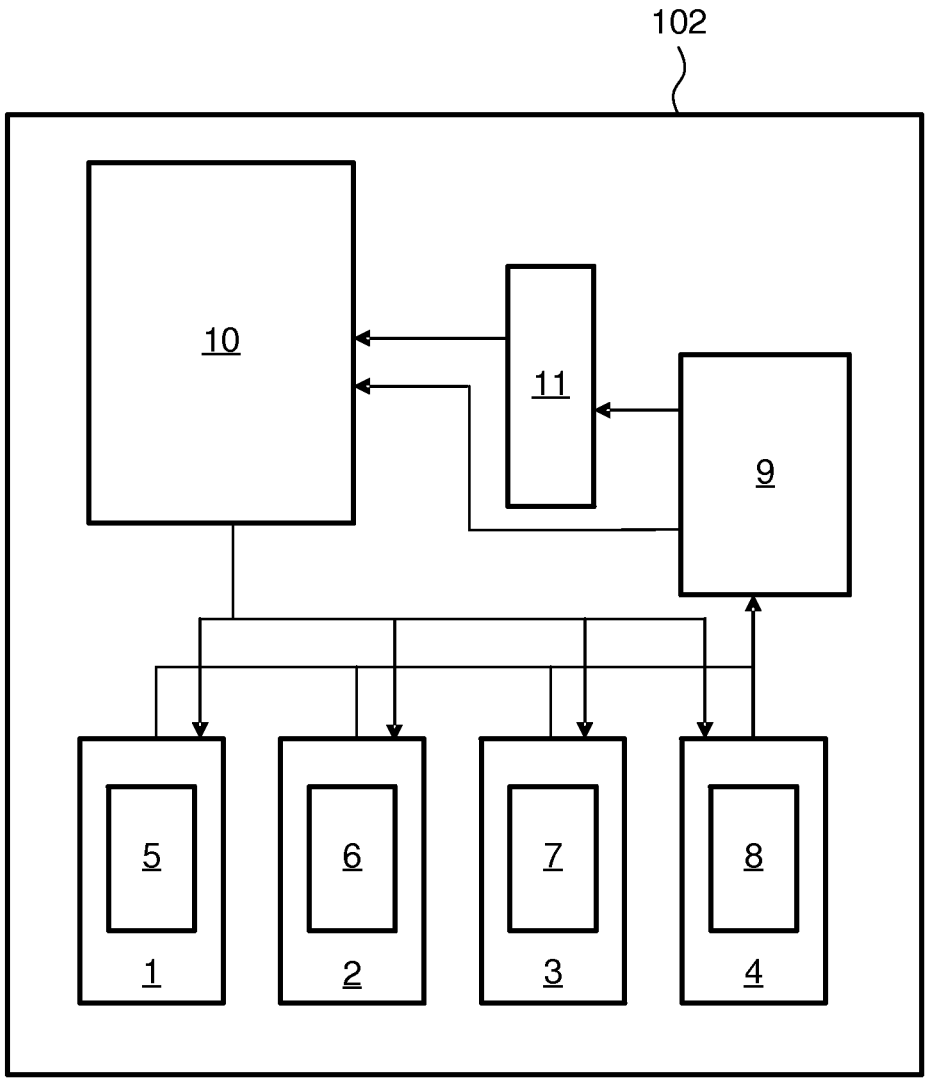
FIG. 3 shows a schematic drawing of the system according to an embodiment of the invention, which includes an information storage unit.

FIG. 3 shows a schematic drawing of the system 102 according to one embodiment of the invention where the system includes also an information storage unit 11. Upon user interaction with the elements the motion sensor 9 senses the movements of the elements. The motion sensor 9 may communicate to the control system 10 which receives information about the motion of the elements and in response to the received information induces a chromatic and luminosity variation in the light emitting devices of the elements as described in FIG. 1. Alternatively the motion sensor 9 communicates with the information storage unit 11. The information storage unit 11 stores information related to the chronological sequence of the motion of the elements and in turn provides the control system 10 with inputs related to the elements' motion history. For example the information storage unit 11 may receive and store information from the motion sensor on a recurrent combination of elements movements produced by the user to communicate a particular emotional state. In turn this information received by the control system is ultimately transduced into a coloration change of the light-emitting device of the elements. In this way to a specific sequence of movement of an element may correspond a specific light variation pattern so that variation in light emission of the light emitting devices on the elements may be at least partially influenced by the motion history of the elements.

Figure 4:
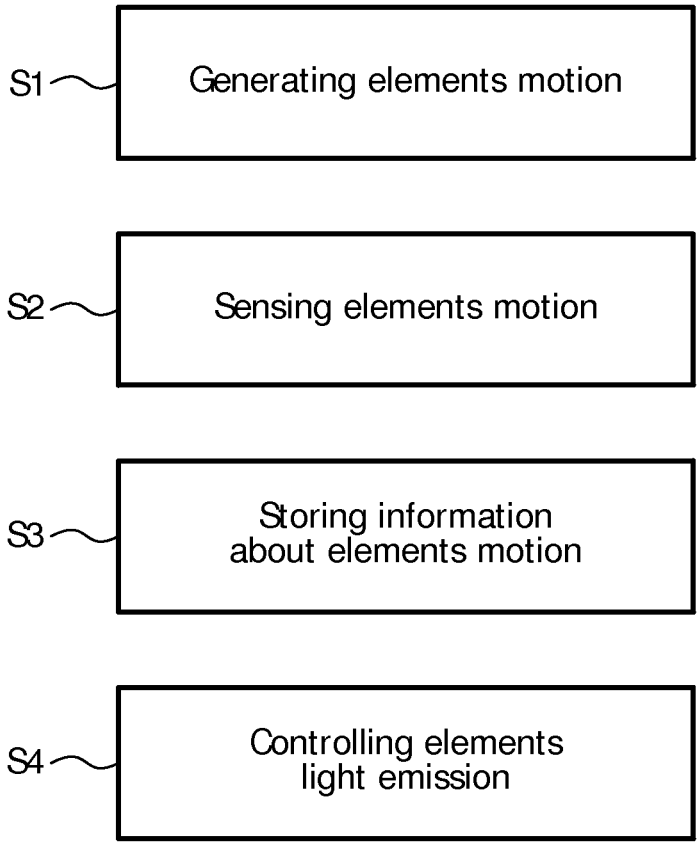
FIG. 4 is a flow-chart of a method according to an embodiment of the second aspect of the invention or of a design of a computer program according to an embodiment of the third aspect of the invention.

FIG. 4 is a flow-chart illustrating a method according to the second aspect of the invention as well as a computer program according to an embodiment of the third aspect of the invention. The method comprises of the steps: S1, generating motion of elements in a system for communication comprising two or more elements; S2 sensing the motion of the elements; S3 storing information on said motion of elements; S4 controlling the emission of the light from said two of more elements by inducing said elements to produce variation in their light emission based on stored chronological sequences of their motion.

Numerous possibilities and different ways to set this up are possible. In one example, the group of mobile phones to be functionally connected in the system may be limited to a group according to a contacts list on a phone, to phones within a limited region (determined by network cells or built in GPS capabilities).

Figure 5:
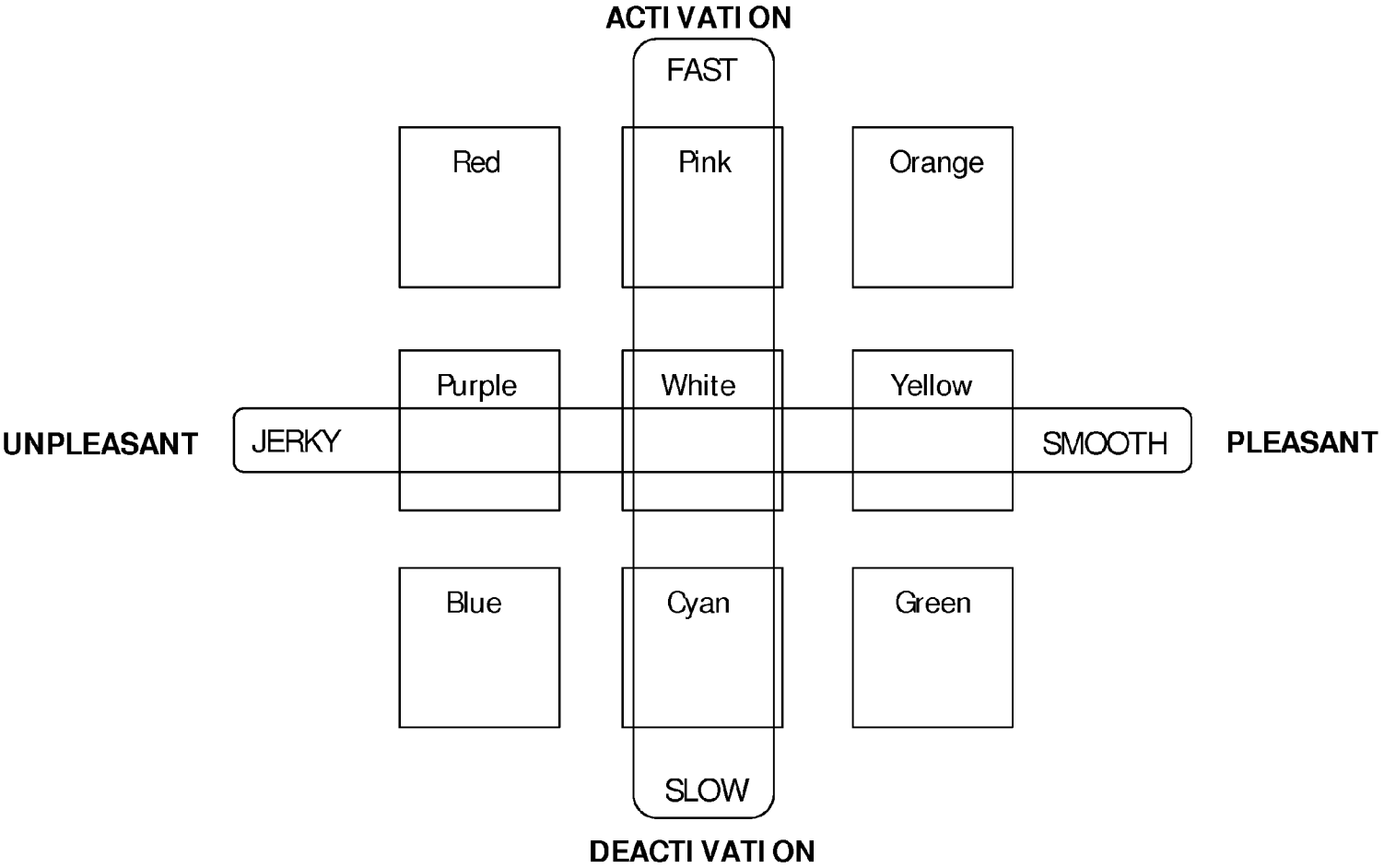
FIG. 5 shows an example of a 2D color scheme for assignment of specific coloration to elements based on their movement patterns.

FIG. 5 shows an example of a 2D color scheme or space for assignment of specific coloration to elements based on their movements. The color variation of each element may be based on a combination of:

i) the characteristics of its own movement, as shown different motion patterns may be identified, e.g. slow, fast, smooth or jerky movements;

ii) an algorithm determining the individual proposed color for each element on the basis of its movement patterns, e.g. a threshold scheme;

iii) an algorithm determining colors of an element, based on its history of movement patterns, e.g. based on the information stored into the information storage unit;

iv) an algorithm determining the color of each element, based on the colors (and histories) of the other elements.

FIGS. 7 to 10 are examples of movement patterns as measured by the motion sensor, which can be classified into four extreme movements of the elements following the 2D color scheme showed in FIG. 5. The input used by the control system to analyze the motion of an element may depend on the type of motion sensors, and may apply a time-averaging function to determine a mean in order to avoid too much flickering due to very small variations in the motion.

Figure 6:
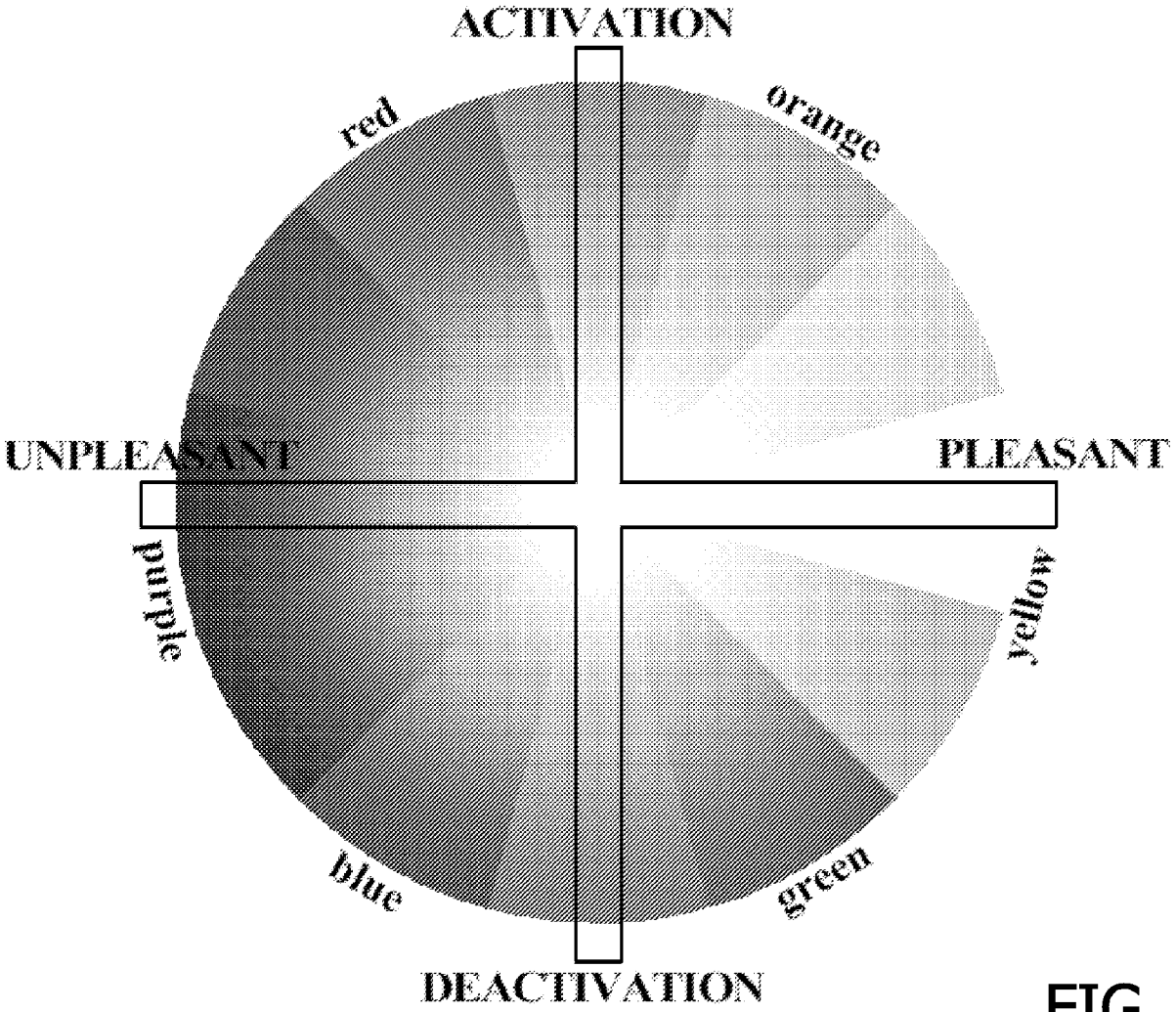
FIG. 6 shows an example of a color scheme that can be mapped to a color circle where the colors fade from one to another.
Figure 7:
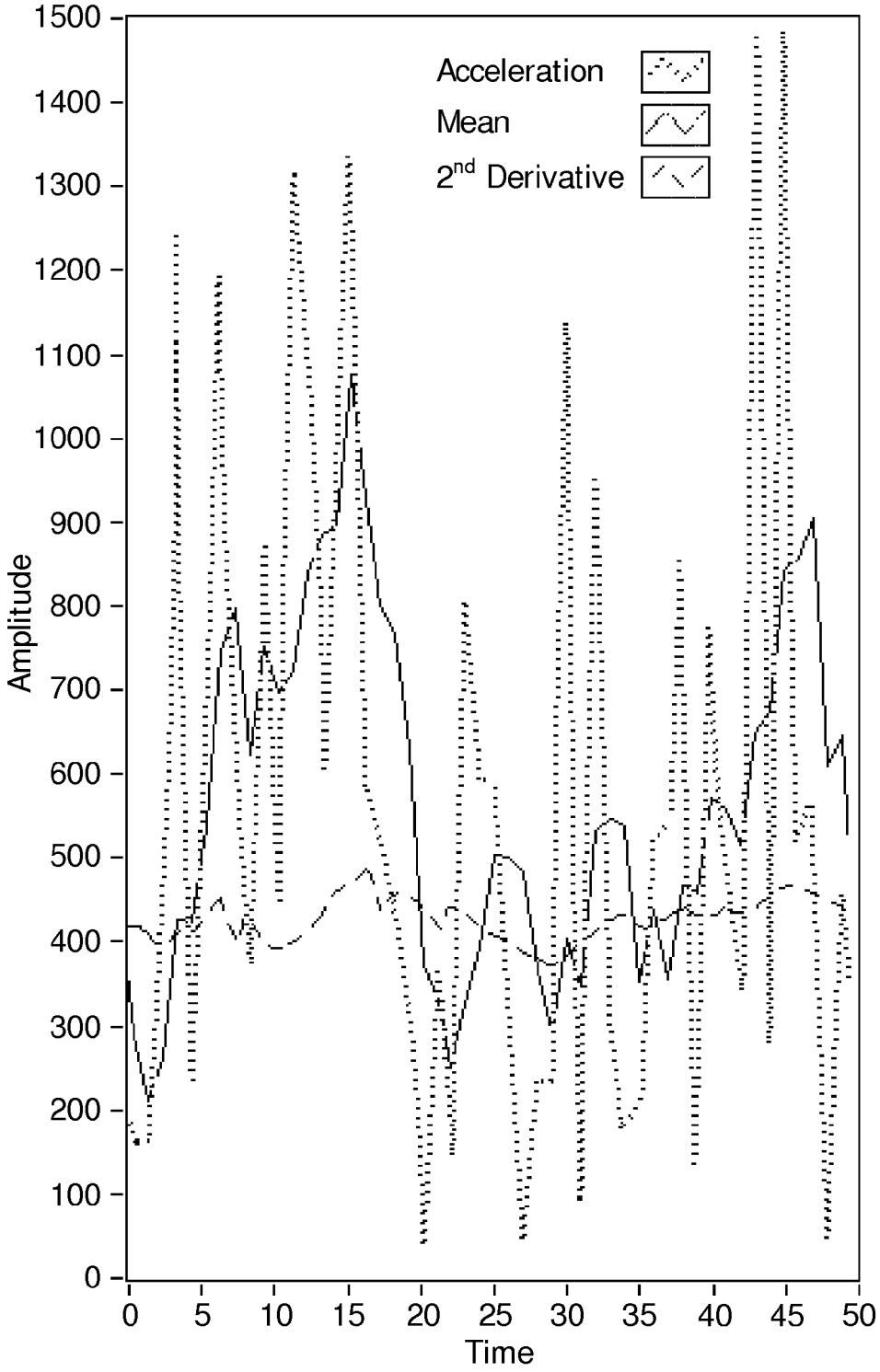
FIGS. 7-10 show examples of movement patterns as measured by the motion sensor which can be classified into 4 extreme movement states.
Figure 8:
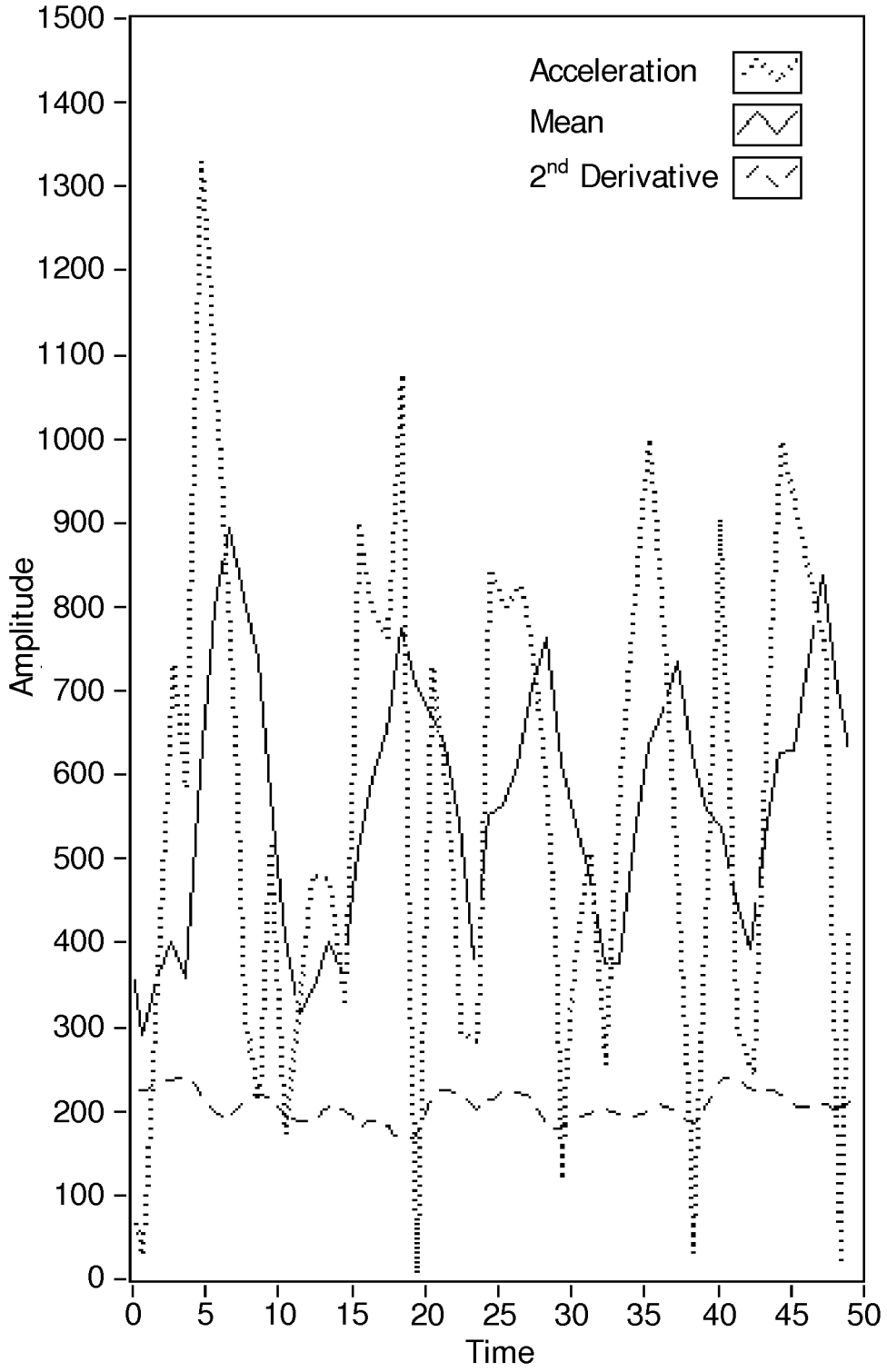
Figure 9:
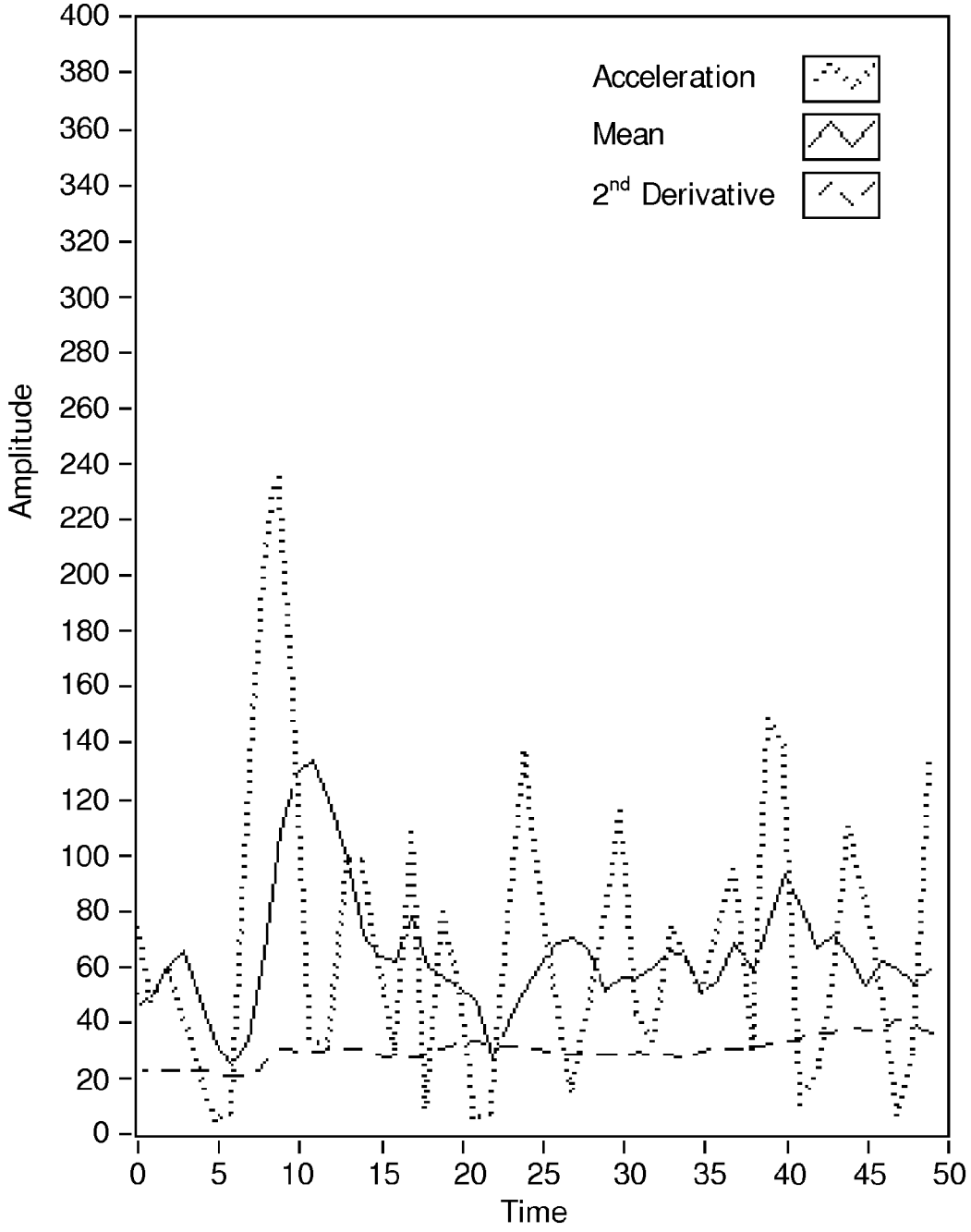
Figure 10:
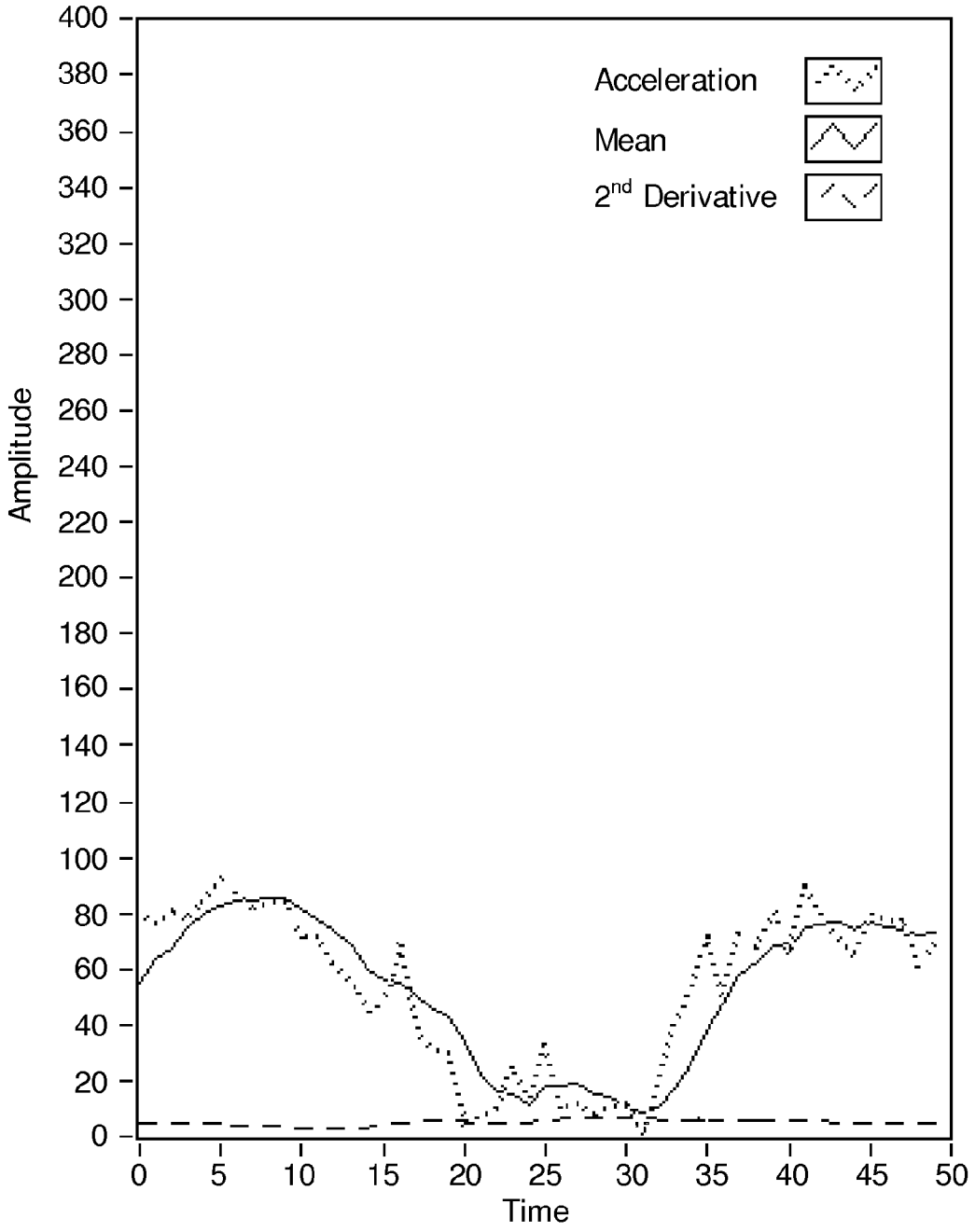

FIG. 7 corresponds to a Fast and Jerky movement. Following the scheme in FIG. 5 a red coloration of the light emitting device of the correspondent element can be assigned to this movement. In practice when the element experiences a fast and jerky movement sensed by the motion sensor as shown in FIG. 6 the control unit will induce a coloration switch of the light emitting device of the element to red. Similarly FIG. 8 shows a fast and smooth movement, which will correspond to an orange color, while FIGS. 9 and 10 represent a slow/jerky and slow/smooth movement corresponding to blue and green coloration respectively.

The 2D color coordinate system of FIG. 5 employing two motion properties is used for simplicity reasons. A multidimensional coordinate system, where each axis is a motion property may be used as a color coordinate system for determining the coloration switch of the elements. The motion of the elements can be analyzed and one or more of the motion properties can be determined by a given coordinate value (corresponding to the characteristics of the motion property). For those not determined their value can be set to zero, (or neutral) or randomized. In this way a motion property space can be constructed and overlapped with a color scheme so that to each motion can be assigned a specific color and intensity. For example FIG. 5 shows a 2D color space where all the other motion properties apart from speed and smoothness are set to zero. The same color may appear in several places in the color space. In FIG. 5 intensity of light could be added by e.g. adding some direction property characteristics, namely up and down: Therefore if an elements experience a fast jerky motion up/down, this may correspond to a red coloration with high luminosity, while if the same fast jerky motion is left/right, the red coloration may have a low luminosity red (same wavelength, but less light intensity).

The coordinates of the motion property in this "motion property space" can be seen as a mapping of people emotions. For example if an unpleasant emotion causes the user of the element to produce a fast and jerky movement that will be showed by a red coloration of the element so that to an unpleasant emotion can be associated the red coloration as shown in FIG. 5.

An n-dimensional movement-color model can be used to extract emotion from movement and give feedback in colored light. An example could be to measure the expression of emotion in movement by the dimensions: activation and pleasantness. Activation can be related to the speed and volume of a movement, with high activation being fast movements, and deactivation being slow movements. Pleasantness can be related to smooth or jerky movements (regular or irregular movements), with smooth movements being pleasant, and jerky movements being unpleasant. This model can be mapped to a color circle where the colors fade from one to another in a natural way as can be seen in FIG. 6. The colors fade to white towards the middle of the circle, because in that point activation and pleasantness are neutral. The motion of the elements can be analyzed and one or more of the motion properties can be determined by a given coordinate value (corresponding to the characteristics of the motion property) and be mapped directly to the appropriate color.

The invention can be implemented in any suitable form including hardware, software, firmware or any combination of these. The invention or some features of the invention can be implemented as computer software running on one or more data processors and/or digital signal processors. The elements and components of an embodiment of the invention may be physically, functionally and logically implemented in any suitable way. Indeed, the functionality may be implemented in a single unit, in a plurality of units or as part of other functional units. As such, the invention may be implemented in a single unit, or may be physically and functionally distributed between different units and processors.

Although the present invention has been described in connection with the specified embodiments, it is not intended to be limited to the specific form set forth herein. Rather, the scope of the present invention is limited only by the accompanying claims. In the claims, the term "comprising" does not exclude the presence of other elements or steps. Additionally, although individual features may be included in different claims, these may possibly be advantageously combined, and the inclusion in different claims does not imply that a combination of features is not feasible and/or advantageous. In addition, singular references do not exclude a plurality. Thus, references to "a", "an", "first", "second" etc. do not preclude a plurality. Furthermore, reference signs in the claims shall not be construed as limiting the scope.

The invention claimed is:

1. An interactive system for coordinating at least one of light and sound emitted by physically separate elements, the system comprising:

a plurality of physically separate elements each adapted to controllably produce at least one of light and sound emissions, at least one of said elements being adapted to be moved separately from others of said plurality of physically separate elements with predetermined detectable motions corresponding with respective predetermined ones of said emissions;

at least one motion sensor for sensing said motions of said at least one element; and a control system adapted to receive inputs from said at least one motion sensor and to control the at least one of light and sound emitted by said at least one element and to control the at least one of light and sound emitted by others of said plurality of physically separate elements in correspondence with the sensed predetermined motion of said at least one element.

2. The interactive system according to claim 1, wherein the at least one motion sensor comprises a plurality of motion sensors, each included in a respective one of said plurality of physically separate elements.

3. The interactive system according to claim 1, wherein said control of light emission comprises controlling at least one of color and luminosity of the emitted light.

4. The interactive system according to claim 1, wherein said control of light emission comprises inducing periodical variations of the emitted light.

5. The interactive system according to claim 1, wherein said interactive system further comprises an information storage unit for storing the inputs from said at least one motion sensor.

6. The interactive system according to claim 5, wherein the control system is adapted to receive inputs from said information storage unit and, in response to said received inputs, to selectively induce said plurality of physically separate elements to produce variations in the light emitted thereby.

7. The interactive system according to claim 1, wherein the control system comprises;

software for determining one or more motion property characteristics of the motion of at least one of the elements from the inputs from the at least one motion sensor; and software for mapping the determined motion property characteristics into a provided space for at least one of light color and intensity;

the control system being adapted to induce the at least one element to emit light according to the respective motion property characteristics position for the at least one element in said provided space.

8. The interactive system according to claim 1, wherein least one of said plurality of physically separate elements comprises a light emitting device for emitting light of diverse colors.

9. The interactive system according to claim 1, wherein at least one of said plurality of physically separate elements comprises a light emitting device including a polychromatic source of light and optical filters.

10. The interactive system according to claim 1, wherein at least one of said plurality of physically separate elements comprises a light emitting device arranged so that emitted light is visible from at least two opposing sides of the at least one element.

11. A method for coordinating at least one of light and sound emitted by physically separate elements, the method comprising the steps of:

effecting movement of at least one of a plurality of physically separate elements separately from others of said plurality of physically separate elements, said at least one element being adapted to controllably produce at least one of light and sound emissions, said movement being in one of a plurality of predetermined detectable motions corresponding with respective predetermined ones of said emissions;

sensing said motions of said at least one element; and controlling the at least one of light and sound emitted by the at least one element and controlling the at least one of light and sound emitted by others of the plurality of physically separate elements in correspondence with the sensed predetermined motion of the at least one element.

12. The method according to claim 11, wherein said method further comprises the step of:

storing information representing the sensed motions of the at least one element.

13. The method according to claim 12, wherein said method further comprises the step of:

controlling the emission of the light from at least one of said physically separate elements by inducing said at least one element to produce a variation in light emission based on at least one stored chronological sequence of the sensed motions.

14. The method according to the claim 11, wherein said step of controlling the at least one of light and sound emitted by the plurality of physically separate elements is performed in real time.

15. A computer program embodied in a non-transitory computer-readable medium for effecting the performance of a method for coordinating at least one of light and sound emitted by physically separate elements, the method comprising:

effecting movement of at least one of a plurality of physically separate elements separately from others of said plurality of physically separate elements, said at least one element being adapted to controllably produce at least one of light and sound emissions, said movement being in one of a plurality of predetermined detectable motions corresponding with respective predetermined ones of said emissions;

sensing said motions of said at least one element; and controlling the at least one of light and sound emitted by the at least one element and controlling the at least one of light and sound emitted by others of the plurality of physically separate elements in correspondence with the sensed predetermined motions of the at least one element.

* * * * *